US005815864A

United States Patent [19]

Sloop

[11] Patent Number: 5,815,864

[45] Date of Patent: Oct. 6, 1998

[54] MICROPROCESSOR CONTROLLER AND METHOD OF INITIALIZING AND CONTROLLING LOW AIR LOSS FLOATATION MATTRESS

[75] Inventor: David J. Sloop, St. Louis, Mo.

[73] Assignee: Sytron Corporation, St. Louis, Mo.

[21] Appl. No.: 626,361

[22] Filed: Apr. 2, 1996

[51] Int. Cl.[6] ..... A47C 27/08

[52] U.S. Cl. ..... 5/706; 5/914; 5/713; 5/710

[58] Field of Search ..... 5/706, 709, 710, 5/713, 714, 914; 324/661, 662, 669

[56] References Cited

U.S. PATENT DOCUMENTS

| | | | |
|---|---|---|---|
| 1,640,618 | 8/1927 | Sampson . | |
| 3,206,776 | 9/1965 | Moore . | |
| 4,051,721 | 10/1977 | Williams . | |
| 4,058,765 | 11/1977 | Richardson et al. . | |
| 4,096,758 | 6/1978 | Moore . | |
| 4,310,806 | 1/1982 | Ogasawara . | |
| 4,330,284 | 5/1982 | Dotsko et al. . | |
| 4,631,767 | 12/1986 | Carr et al. . | |
| 4,686,722 | 8/1987 | Swart . | |
| 4,841,224 | 6/1989 | Chalupnik et al. . | |
| 4,864,671 | 9/1989 | Evans | 5/710 |
| 4,873,737 | 10/1989 | Savenije | 5/706 |
| 4,944,060 | 7/1990 | Peery et al. . | |
| 4,949,412 | 8/1990 | Goode . | |
| 4,962,552 | 10/1990 | Hasty . | |
| 4,989,283 | 2/1991 | Krouskop | 5/713 |
| 5,012,196 | 4/1991 | Baranski . | |
| 5,020,176 | 6/1991 | Dotson | 5/710 |
| 5,022,110 | 6/1991 | Stroh . | |
| 5,051,673 | 9/1991 | Goodwin | 5/713 |
| 5,168,589 | 12/1992 | Stroh et al. . | |
| 5,235,713 | 8/1993 | Guthrie et al. . | |
| 5,237,307 | 8/1993 | Gritton . | |
| 5,243,721 | 9/1993 | Teasdale . | |
| 5,249,319 | 10/1993 | Higgs . | |
| 5,251,349 | 10/1993 | Thomas et al. . | |
| 5,279,010 | 1/1994 | Ferrand et al. . | |
| 5,323,500 | 6/1994 | Roe et al. . | |
| 5,440,501 | 8/1995 | Shimomura et al. . | |
| 5,483,709 | 1/1996 | Foster et al. . | |
| 5,487,196 | 1/1996 | Wilkinson et al. . | |
| 5,489,888 | 2/1996 | Jagiella et al. . | |
| 5,546,008 | 8/1996 | Sminchak et al. . | |

*Primary Examiner*—Steven N. Meyers
*Assistant Examiner*—Tuyet-Phuong Pham
*Attorney, Agent, or Firm*—Polster, Lieder, Woodruff & Lucchesi, LC

[57] ABSTRACT

An air pressurization and control system for a low air loss air floatation mattress or cushion is disclosed. The control system controls air supplied to the air floatation mattress within a range of pressures and flowrates so as to inflate all of the cells of the mattress and to maintain a flow of air to all of the cells over an extended period of time while maintaining all of the cells at a desired level of inflation for the air floatation support of the patient without any of the cells exerting decubitus pressures above the maximum desired decubitus pressure and so as to prevent collapse of any of the cells. A sensor is provided for sensing the pressure of the air within the common supply. The controller includes a microprocessor for initializing the controller to a particular patient to be supported by the mattress and for the air floatation support of the patient over an extended period of time without exceeding a maximum decubitus pressure on any portion of the person's body in contact with the mattress and without permitting any of the cells to collapse. The initializing procedure comprises inflating the mattress with the person supported thereon and determining when at least one of the cells becomes fully inflated thereby determining a maximum inflation pressure not to be exceeded during the course of treatment and then deflating the mattress and determining the pressure at which at least one of the cells collapses thereby determining a lower pressure level above which pressure within the mattress is to be maintained during the course of treatment. The controller monitors the pressure of the air supplied to the common source and regulates operation of the source of pressurized air so as to be at a predetermined pressure between the minimum and the maximum pressure.

4 Claims, 6 Drawing Sheets

MICROPROCESSOR CONTROLLER AND METHOD OF INITIALIZING AND CONTROLLING LOW AIR LOSS FLOATATION MATTRESS

BACKGROUND OF THE INVENTION

This invention relates to a pressurizing system for inflating a low air loss floatation mattress (or other supporting cell system or sub-system) so as to insure that excessive bearing forces are not exerted on the tissue of the person using the mattress (or pad) over extended periods of time so as to minimize the tendency of the person using the mattress from developing ulcers (bed sores) and to enhance comfort. This invention further has application as a support cushion system or sub-system of support cells for wheelchair seats or for other chair cushions where the user spends long periods of time in the chair and where comfort is important to the functioning of the user.

Referring now to patients confined in bed or in wheelchairs for extended periods, such patients may tend to develop bed sores. This is particularly true if the portions of the patient's body bearing on the mattress or cushion have a decubitus or interface pressure exerted on them greater than about 28 mm Hg or about 15–20" of water. The heart and the circulatory system can overcome and maintain adequate circulation to such parts of the patient's body if the decubitus pressure is less than about 10" of water. If the pressure exceeds this limit over a long period of time, improper circulation may result and the patient may develop bed sores and/or other medical problems related to restricted limb or torso blood circulation.

Air floatation mattresses have been developed to minimize the tendency of the patient to develop bed sores. One type of air floatation mattress, referred to as a low air loss mattress, has a number of separate chambers or pillows extending transversely of the mattress which are inflated with air to a desired pressure so the pillows will support various parts of the body without applying excessive decubitus pressures to any one part of the patient's body. For example, one such prior art air floatation mattress system has 16 cells grouped into head, torso, and leg zones. Air is continuously pumped under pressure (up to about 10" of water) from an air pressurization source, such as a variable speed blower or air pump, into a common manifold or plenum and the air from the plenum enters the cells comprising the torso zone of the mattress. The outer cells of the torso zone are, respectively, in communication with the next adjacent cell constituting the first cell of the adjacent head or foot zones so that air from the first cells of the head and foot zones are supplied with air from the torso zone. All of the cells comprising the head and foot zones are in communication with one another. In this manner, all of the cells of the mattress are continuously supplied with air from the blower. In other low air loss mattresses, all of the cells may be supplied with air directly from the common air manifold or supply. All of the cells have a multiplicity of air discharge holes therein so that air is continuously lost from all of the cells and so that air must constantly be supplied to the cells so as to maintain the cells at their desired inflated pressures. Other types of low air loss mattresses are known where all of the cells are supplied air directly from the air manifold.

Currently, upon placing a new patient on one of these prior art low air loss floatation mattresses, a skilled nurse must set up the mattress and the blower so that none of the cells exerts excessive decubitus pressures on any area of the patient. This takes time and the nurse must have special training and equipment to carry out this task. This setup task may involve inserting a pressure measuring device between the patient and the mattress so as to determine the decubitus pressure and to then regulate the air pressure and flow of the continuously operable blower so as to not exceed a desired pressure level. Often, it is necessary for the nurse or technician to input the patient's height and weight data into the controller so as to initialize the operation of the blower to the particular patient to be supported on the mattress.

Reference may be made to the following prior art U.S. Patents which show low air loss mattresses and other types of air floatation mattresses and support cushions and air supply systems therefore: U.S. Pat. Nos. 4,631,767, 4,686,722, 4,944,060, 5,022,110, 5,168,589, 5,235,713, 5,249,319, 5,279,010, 5,323,500, 5,483,709 and 5,487,196.

SUMMARY OF THE INVENTION

Among the several objects and features of the present invention may be noted the provision of a control system for supplying air to a low air loss mattress or pad which may be automatically initialized for a particular patient in such manner that a skilled nurse or special equipment is not required to set the mattress and/or the blower for a particular patient;

- The provision of such a control which operates to automatically initialize or adapt itself to a new patient by laying on the mattress and by initiating an initializing procedure of the control system such that neither trained personnel or special equipment is required to regulate the air source for the mattress so as to supply air at a particular pressure and flow rate so as to maintain all of the cells of the mattress in an inflated condition and without being fully inflated thereby to insure that the decubitus pressure on any part of the person's body does not exceeds a predetermined level;
- The provision of such a control system which, once initialized, will maintain a continuous flow of pressurizing air to the cells of the low air loss mattress so that none of the cells exceeds a predetermined maximum pressure or drops below a minimum pressure level thereby to insure that a maximum decubitus pressure is not exceeded and so that all portions of the patient's body are supported by the air floatation mattress;
- The provision of such a control system which may be programmed to vary the pressure of the air loss mattress in such manner as to periodically alternate the pressure within the mattress between a predetermined pressure level above and below a desired setpoint pressure so as to vary the pressure supporting the patient while not exerting a pressure on any part of the patient above a predetermined maximum decubitus pressure and while not allowing the cells of the mattress to filly collapse;
- The provision of such a control system which may be utilized to directly control and monitor the pressure in each cell;
- The provision of such a pressurizing system which, after the above-noted initialization procedure, maintains a sufficient flow of air into the low air loss mattress so as to support the person without exceeding a predetermined maximum decubitus pressure (e.g., 10" of water) and without allowing any of the cells of the mattress to collapse; and,
- The provision of such a control system which is inexpensive to manufacture and use, which is reliable in operation, and which has a long service life.

Briefly stated, a pressurization system of the present invention for a low air loss air floatation mattress or cushion is disclosed. The mattress has a plurality of separate cells with each of the cells having an air inlet and a plurality of air outlets. At least some of the air inlets for certain of the cells are in communication with a common supply of pressurized air such that air from the source enters each of the cells at a rate faster than air from within the cell is vented via the outlets such that the cells are maintained in an inflated condition so as to support the portion of a person's body in contact with the cells with a decubitus pressure less than a desired maximum decubitus pressure. The pressurization system comprises a source for continuously supplying air under pressure to the common supply. A controller is provided for controlling the source to supply air to the common source within a range of pressures and flowrates so as to inflate all of the cells and to maintain a flow of air to all of the cells over an extended period of time while maintaining all of the cells at a desired level of inflation for the air floatation support of the patient without any of the cells exerting decubitus pressures above the maximum desired decubitus pressure and so as to prevent collapse of any of the cells. A sensor is provided for sensing the pressure of the air within the common supply. The controller includes a microprocessor responsive to signals generated by the sensor for initializing the controller to a particular patient to be supported by the mattress and for the air floatation support of the patient over an extended period of time without exceeding a maximum decubitus pressure on any portion of the person's body in contact with the mattress and without permitting any of the cells to collapse. The initializing procedure comprises inflating the mattress with the person supported thereon and determining when at least one of the cells becomes fully inflated thereby determining a maximum inflation pressure not to be exceeded during the course of treatment and then deflating the mattress and determining the pressure at which at least one of the cells collapses thereby determining a lower pressure level above which pressure within the mattress is to be maintained during the course of treatment. The controller monitors the pressure of the air supplied to the common source and regulates operation of the source of pressurized air so as to be at a predetermined pressure between the minimum and the maximum pressure.

The method of the present invention involves the initialization and control of the inflation of a low air loss air floatation mattress or other pad so as to support a person's body with a decubitus pressure maintained below a desired maximum decubitus pressure level during an extended period of use and so as to insure that no portion of the mattress collapses during the extended period of use. An air supply system is utilized which continuously supplies air to the mattress. The mattress has an air inlet and a multiplicity of air discharge opening such that air must be continuously supplied to the mattress at a flowrate and pressure to maintain the mattress at a desired inflation pressure. The method comprises the steps of placing the person to be supported by the mattress on the mattress. The mattress is then inflated, and the rate of the change of the inflation pressure of the mattress is monitored. The pressure at which at least a portion of the mattress becomes fully inflated is determined. Then, the mattress is deflated and the pressure at which at least a portion of the mattress attains at least a partially collapsed condition is determined. Operation of the source of pressurized air is controlled over an extended period of time so as to maintain a pressure within the mattress intermediate the full inflation pressure and the collapse pressure whereby the person is supported by the mattress with a decubitus pressure less than a desired maximum decubitus pressure.

Other objects and features of this invention will be in part apparent and in part pointed out hereinafter.

BRIEF DESCRIPTION OF THE DRAWINGS

Corresponding reference characters represent corresponding parts throughout the several views of the drawings.

DESCRIPTION OF PREFERRED EMBODIMENTS

Figure 1:
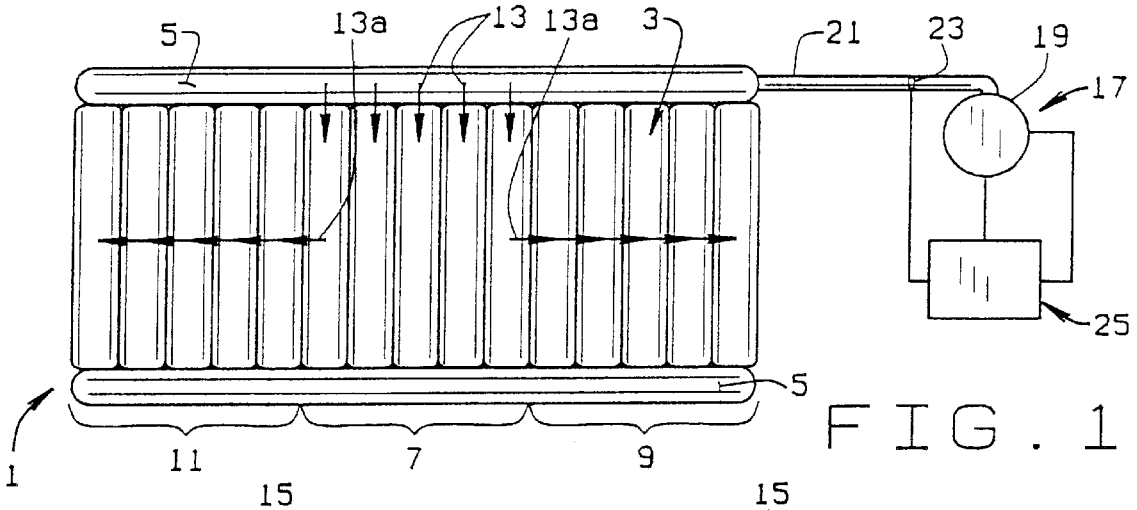
FIG. 1 is a top plan view of a low air loss mattress having a plurality of cells, a blower for continuously supplying air at a desired pressure and flowrate to a common manifold so as to maintain the cells in an inflated condition between a maximum and a minimum pressure level and a microprocessor controller for controlling operation of the blower.
Figure 2:
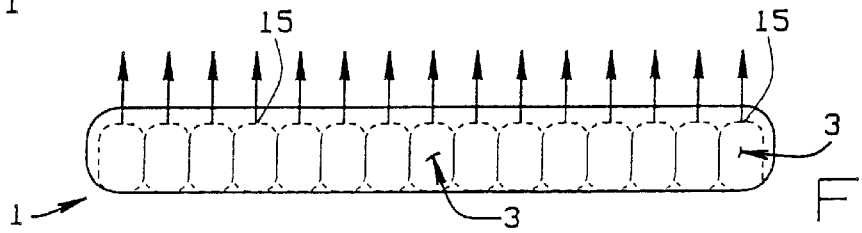
FIG. 2 is a side elevational view of the low air loss mattress shown in FIG. 1 with all of the cells fully inflated.

Referring now to the drawings and particularly to FIGS. 1 and 2, an air floatation mattress, as generally indicated at 1, is diagrammatically shown on which a patient P is supported while, for example, a patient is undergoing an extended period of treatment or is bed ridden. Such air floatation mattresses are particularly beneficial in supporting the patient in such manner as to prevent or minimize the formation of decubitus ulcers (bedsores) which may result from the patient being confined in bed for extended periods of time. While mattress 1 is herein described as a bed mattress on which the patient lies, it will be understood that the present invention may be used with other air floatation supporting pads, such as wheelchair cushions. It will be further appreciated that the present invention need not be confined to the health care field, but may be useful in any application where a person is to be supported in one position for an extended period of time, such in a computer work station chair, in the driver's seat of an over the road truck, the cushions of a reclining chair, a computer workstation chair, the seat of an airliner or train in which a person must sit for extended periods of time. Thus, the term "mattress" as used herein refers not only to a low air loss mattress, but also to such chair pads or other person support devices which may include air floatation cells or the like.

As illustrated in FIGS. 1–6, mattress 1 is a so-called low air loss mattress which means that air under pressure ranging between 0 and up to about 15 inches of water pressure is continuously supplied to the mattress and that air is continuously exhausted from the mattress at approximately the same rate that air enters the mattress (under steady state conditions) so as to maintain the mattress at a constant desired level of pressure or inflation to support the patient reclining thereon. The particular construction of the low air loss mattress is not important to the construction or operation of either the controller or method of the present invention, and the mattress described below and shown in FIGS. 1 and 2 is shown primarily for describing the environment of the present invention. It will be understood by those skilled in the art that low air loss mattresses and pads of constructions different from the mattress herein described may be used equally well with the controller and method of this invention, as hereinafter described.

By way of example, mattress 1 may have a plurality of cells or cushions 3, each of which is an inflatable bladder made of a limp fabric or film material which is substantially air impervious. For example, mattress 1 may be formed of a suitable fabric, such as a relatively heavy weight (200 denier) ripstock nylon or the like, which is stitched and sealed or which is ultrasonically welded to form the mattress. While mattresses of various configurations and constructions may be used with the controller of the present invention, one such mattress that has worked well is the AL-500 low air loss mattress marketed by Therapy Concepts, Inc. of St. Louis, Mo.

As shown in FIGS. 1 and 2, mattress 1 has fifteen such cells 3. Air for pressurizing and inflating these cells is supplied from a common supply or manifold 5. As shown, there are two such manifolds, one on each side of the mattress. These manifolds are preferably formed of the same fabric or film as the cells and serve not only as the manifold, but also as the side rails of the mattress. As shown, however, air is supplied to the cells from only one of the side manifolds or rails and provide lateral stability, since they are inflated to a higher pressure than the vertical support cells 3. The cells of mattress 1 are shown to be arranged in three zones including a seat or torso zone 7 for supporting the seat and torso areas of the patient P, a head zone 9 for supporting the shoulders, neck and head of the patient, and a leg and foot zone 11 for supporting the legs and feet of the patient.

Each of the cells 3 of the seat zone 7 has an air inlet 13 through which air under pressure may enter the cell to inflate or to maintain inflation. As shown in FIG. 1, the cells forming the torso or seat zone 7 have their inlets 13 in communication with plenum 5 so that air under pressure within the plenum may enter each of the cells constituting the torso zone thereby to directly inflate the cells of the torso zone. In the particular embodiment of low air loss mattress 1 illustrated in FIGS. 1 and 2, the cells of the head zone 9 and the foot zone 11 next adjacent the cells of the seat zone 7 have their respective air inlets, as indicated at 13*a*, in communication with a respective next adjacent cell of the seat or torso zone 7 such that air under pressure from the torso zone enters the next adjacent cells of both the head and the foot zones to inflate (and to maintain the inflation of) the adjacent cells of the head and foot zones. Each of the other cells of the head and foot zones has a respective air inlet 13*a* which receives air from the next adjacent cell of the head or foot zone toward the torso zone such that all of the cells of the head and the foot zones are also supplied with air under pressure from the torso zones. In this manner, all of the cells 3 of the mattress are supplied with air from plenum 5 to inflate and to maintain inflation of all of the cells. However, those skilled in the art will understand that each of the cells of all of the zone may have an air inlet in register with the plenum 5 such that each of the cells may be supplied with air under pressure directly from the plenum.

Further, each cells 3 has at least one, and preferably a plurality of, air outlets 15 of a predetermined vent area for continuously venting air under pressure from within the cells to the atmosphere. Air outlets may be a predetermined number of openings or holes formed in each of the cells so as to provide the above-noted predetermined discharge area so that the rate of air vented to the atmosphere is of a predetermined volume (depending on the pressure of the air within the cell) such that air supplied via the air inlets 13 and 13*a* may inflate and/or maintain the inflation of cells 3 in a desired inflation state. For example, air inlets 13 may be apertures of a known or predetermined cross sectional air such that air from plenum 5 may enter cells have air inlets 13 in communication with the plenum 5 to enter and inflate the cells of the torso or seat zone 7 and to enter and inflate the cells of the head and foot zones 9 and 11, respectively, at a rate sufficient to permit all of the cells of mattress 1 to inflate to a desired level and to support patient P thereon and to maintain this desired inflation level even as air is continuously vented to the atmosphere via the air outlets 15. Controlled air loss rate can also be selectively and more evenly controlled through the top surfaces of the cells (where it can most effectively contribute to the comfort level of the person being supported by helping prevent moisture buildup at the patient/mattress interface), by chemically dissolving a portion of the thin plastic coating on the inside of the cell mesh or fabric material (as by wiping the inside of the surface lightly with a cloth or the like saturated with acetone or other solvent during assembly of the mattress.) Air outlets 15 may, for example, constitute air holes formed in the material forming cells 3. The number and area of these air outlet holes is predetermined or controlled such that the air entering the cells from the plenum at a desired maximum pressure level will be such as to maintain the mattress in a desired inflated condition. Alternatively, the material from which the cells is made may have a predetermined porosity factor such that air will uniformly leak from the material at a known rate relative to the internal air pressure within the cells such that air from the plenum will have to be continuously supplied to the cells to maintain them in a desired inflated condition. For example, air may be discharged from each of the cells 3 at a rate of about 0.001–0.2 cfm at a cell inflation pressure of about 10 inches of water.

As indicated generally at 17 in FIG. 1, a first embodiment of an air pressurization system of the present invention for supplying air to a low air loss mattress 1 is shown to comprise a continuously operable, variable speed air blower 19. While the construction and operation of blower 1 are not central to the system and method of the present invention, one blower that has been used and preferred is a Model 116630-01 brushless DC motor driven bypass blower commercially available from Ametek Technical Motor Division of Kent, Ohio which has an infinitely variable speed blower and which can deliver up to about 60 cfm of air and pressures up to about 80 inches of water.

Air discharged from blower 19 enters a flexible air duct 21 for delivery of the air under pressure to plenum 5 of air mattress 1. As indicated at 23, an air pressure sensor is in pressure sensing relation with the air discharged from blower 19 into duct 21. As shown in FIG. 1, the sensor 23 is mounted within duct 21, but it will be appreciated that the sensor need not be physically located within the duct. In certain instances, the sensor may be preferably mounted on the printed circuit board for the controller of the present invention and be in air pressure sensing relation with the air in duct 21 by way of a sensing tube, as shown in the embodiments illustrated in FIGS. 10 and 11 which will be discussed in detail hereinafter. Air pressure sensor 23 continuously generates an electrical signal indicative of the instantaneous relative pressure (with respect to still room air) within air supply duct 21 and within manifold or plenum 5. For example, sensor 23 may be a model MPX10DP series silicon pressure sensor using a differential port option commercially available from Motorola or an MPX5010DP which includes temperature compensation and gain for operation over a wider temperature range. The latter sensor may be preferred for wheelchair applications.

Figure 15:
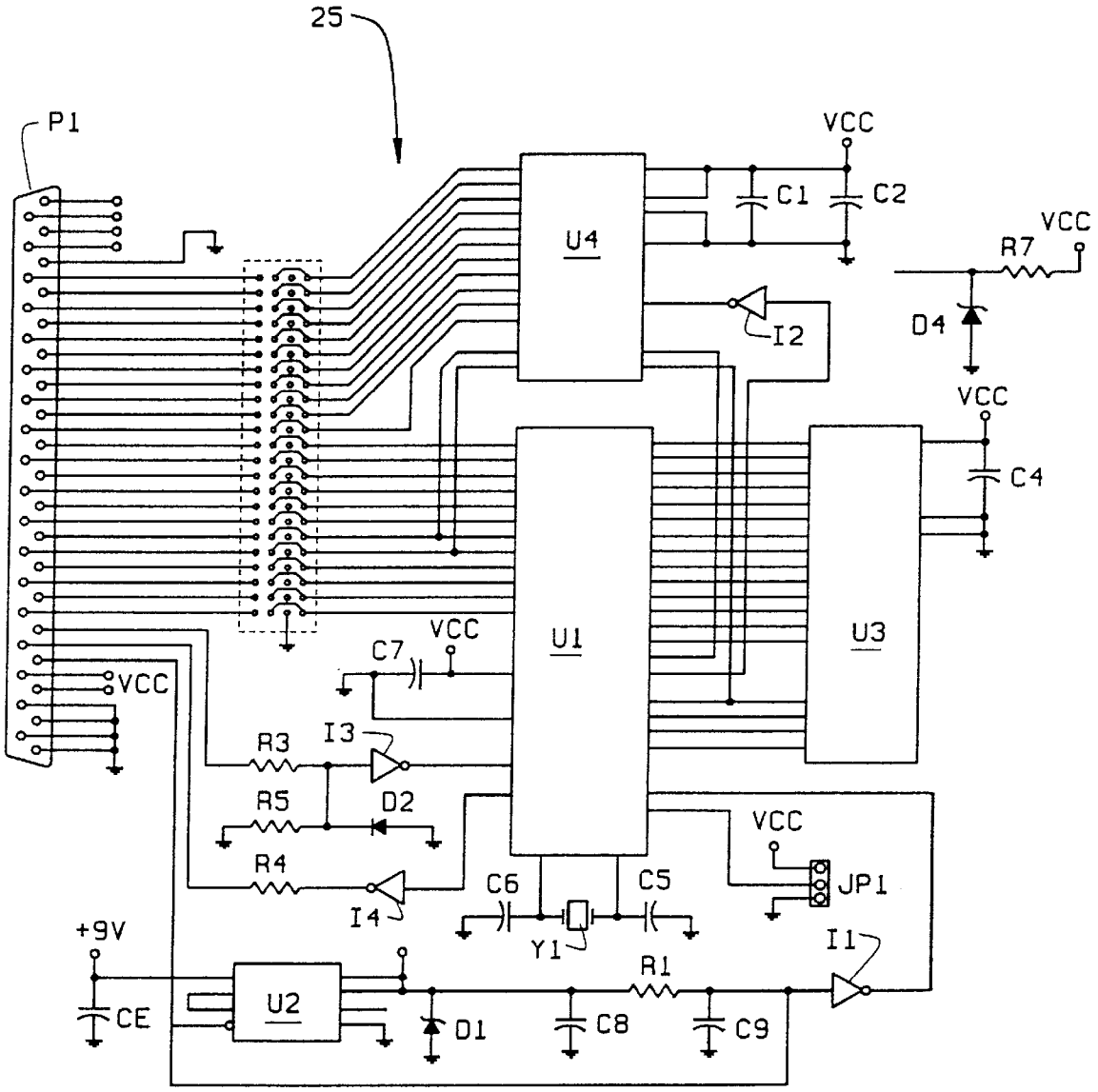
FIG. 15 is an electrical schematic of microprocessor that connects to the control circuit of FIG. 14 where the microprocessor controls operation of the control circuit.
Figure 16:
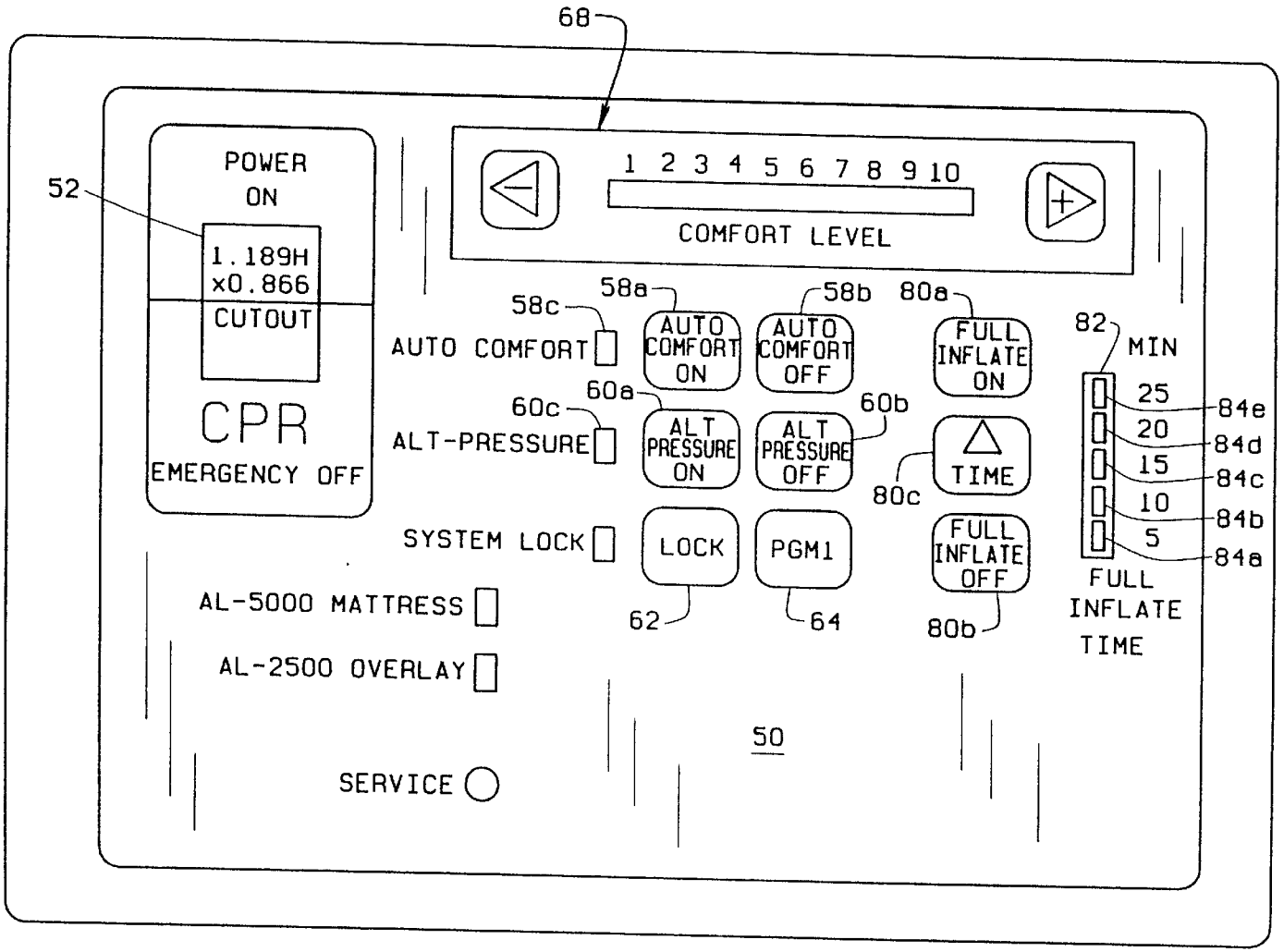
FIG. 16 is a view of the control panel for the controller of the present invention for monitoring and controlling operation of the control system shown in FIGS. 14 and 15.

As generally indicated at 25, a first embodiment of a microprocessor controller, the details of which are illustrated in FIGS. 15 and 16 and which will be described in detail hereinafter, is provided for controlling operation of blower 19 so as to supply air to mattress 1 in accordance with the method of the present invention. The controller is programmed to carry out an automatic initialization procedure for setting the controller to inflate and to maintain inflation of mattress 1 with a particular patient P to be supported on mattress 1 for the air floatation support of the patient over an extended period of time without exceeding a maximum allowable decubitus pressure (e.g., 10 inches of water) on any portion of the patient's body in contact with mattress 1 and without permitted any of the cells 3 of the mattress to collapse. As used in this disclosure, the term "decubitus pressure" refers to the interface pressure between a person's body and the support supporting that portion of the patient's body. Thus, the term "decubitus pressure" may be used interchangeably with the term "interface pressure".

It will be appreciated that pressurization system 17, blower 19 and controller 25 may be mounted within a suitable enclosure or case 27 (shown in FIG. 10) which may be operatively connected to mattress 1 by suitable hoses and wires. This cabinet or case 27 is provided with the operating panel shown in FIG. 16 so as to allow the technician or nurse to control operation of the mattress and controller of the present invention.

In accordance with a first embodiment of method of the present invention, controller 25 is operable to initialize itself so as to determine at what pressure the cells 3 of the seat zone 7, the head zone 9, and the foot zone 11 should be pressurized so as to support a particular patient P in such manner that the lowest possible decubitus or interface pressure is exerted on the patient while insuring that all portions of the patient's body are supported in an air floatation manner. It will be understood that prior to the present invention, it was a difficult and time consuming matter for a skilled nurse, technician, or the like to set up the control systems for prior art air floatation mattresses so that maximum desired decubitus or interface pressures were not applied to the patient because each patient varied considerably and the patient's height and weight and the distribution of weight must be taken into account. In addition, each time the patient significantly moved on the mattress or raised the hospital bed on which the mattress was supported to more of a sitting position, the setup of the prior art air mattress controllers would no longer be properly set for best supporting the patient.

In order to initialize a low air loss mattress 1 controlled by controller 25 of the present invention, such initialization procedure is carried out automatically in a few minutes by a person without any special training and substantially without any effort on the part of the person performing the initialization procedure. In the initialization procedure, the patient P is laid on the mattress, as shown in FIG. 1, and, referring to FIG. 16, the "Auto Comfort" button is pushed. This initiates the automatic pressure setting cycle in which the microprocessor sets the air pump 19 to a series of high and low settings while monitoring and recording pressure and time readings. The end of the high and low pump setting cycle is detected by measuring a relatively rapid increase and decrease in the rate of change of pressure with respect to time, respectively. A running sum of: a) the pressure times the time (p×time), and b.) the rate of change in pressure with respect to time (dp/dt) times the time (dp/dt×time) is recorded during this cycle to form, along with the total time required to complete the cycle, a characterizing "fingerprint" of the Autocomfort cycle of this invention.

This type of curve moment calculation (i.e., the sum of pressure×time and the sum of dp/dt×time) uses less computer memory than trying to record many hundreds of pressure and time data points to characterize the cycle. At the end of the Autocomfort cycle, the microprocessor compares the total cycle time and moment sums to values stored in memory location X.8136–X.8159 of the microprocessor which correspond to data tables obtained from using particular mattresses and patients under controlled conditions. For example, the memory parameters listed on the last page of Appendix A attached hereto correspond to measured parameters for 100, 165, and 250 pound test patients on model "5000" and "2500" air support mattresses commercially available from Therapy Concepts, Inc. of St. Louis, Mo. At the end of the Autocomfort cycle of the present invention, as indicated in tiny BASIC command lines 800–898 of Appendix A, controller 25 determines which set of test parameters are closest and next closest to the unknown parameters obtained on the Autocomfort cycle with the unknown patient P. The program then selects the air pressure setting to the value corresponding to the pressure in the "best fit" table, plus or minus a correction factor, depending on the next closet fit setting (weighted by a closeness of fit parameter depending on how much error is involved in the "best fit"). Tight memory constrains limit the number of parameters and the complexity of the fit determination. Embodiments which use the BE-440 model microprocessor with full floating point arithmetic BASIC and 4K of memory can fit far more closely than the integer arithmetic Tiny BASIC Xplor 32*a* microprocessor described above in regard to FIG. 15.

Figure 3:
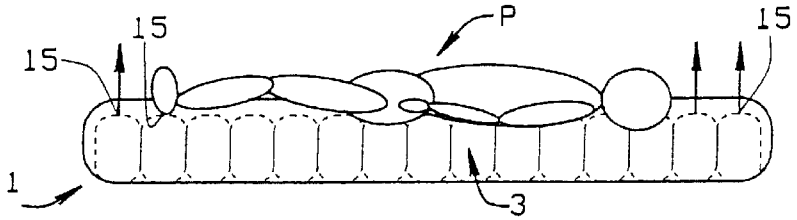
FIG. 3 is a side elevational view of the low air loss mattress with a person supported thereon and illustrates a first step of the automatic initialization procedure of the control system of the present invention wherein the cells of the mattress are inflated with the person supported on the mattress until at least one of the cells is fully inflated.
Figure 7A:
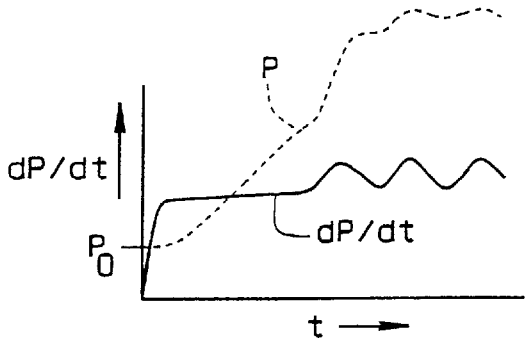
FIG. 7A is a graph illustrating a first step of the initializing procedure of the present invention in which the pressure within the cells of the mattress is increased with full inflation of at least one of the cells of the mattress causing a substantial rise in the rate of the change of pressure.

This will cause the blower 19 to supply air to plenum 5 at such a flow rate and at such a pressure that all of the cells will increase in pressure until all of the cells are fully inflated, as shown in FIG. 3. As the cells are undergoing full inflation, the controller 25 monitors the air pressure within duct 21 via sensor 23. As shown in FIG. 7A, the pressure in the plenum vs. time (shown as a dotted line in FIG. 7A) starts off at initial pressure $P_o$ and increases at a more or less steady rate. The microprocessor also determines the rate of change of pressure vs. time (i.e., dp/dt) within the duct 21 which is depicted as a solid line in FIG. 7A. Upon one of the cells 3 becoming fully inflated such that the fabric forming the cell is stretched taut, that cell is then substantially restrained against further increases in volume. Thus, upon a first cell becoming fully inflated, it has been found that the rate of change of the pressure (dp/dt) will momentarily rise sharply, as shown in FIG. 7A, at a rate substantially faster than the inflation rate of the mattress prior to any of the cells becoming fully inflated. As each of the other cells becomes fully inflated, such full inflation of these other cells will also cause a momentary sharp rise in the rate of the pressure increase. These momentary increases in pressure or the momentary increases in the rate of change in pressure (dp/dt) may readily be monitored and determined by the microprocessor controller 25 in the manner as will be hereinafter described in detail.

In accordance with this invention, the determination of when the first cell of the mattress 1 becomes fully inflated determines or establishes a maximum cell pressure which should not be exceeded while the particular patient P is supported on the mattress. As will be explained hereinafter, in fact, the operating pressure of the mattress desirably should be substantially below this full inflation pressure.

Figure 4:
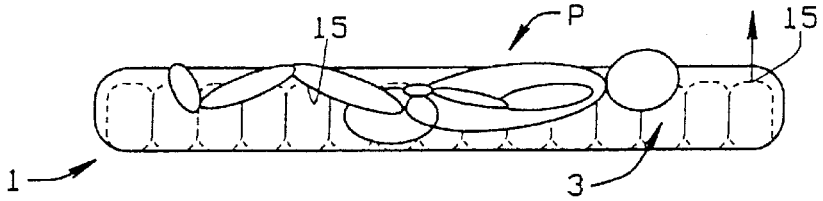
FIG. 4 is a side elevational view of the low air loss mattress illustrating a second step in the initialization procedure of the present invention in which the mattress with a person supported thereon is deflated until at least one cell collapses.
Figure 5:
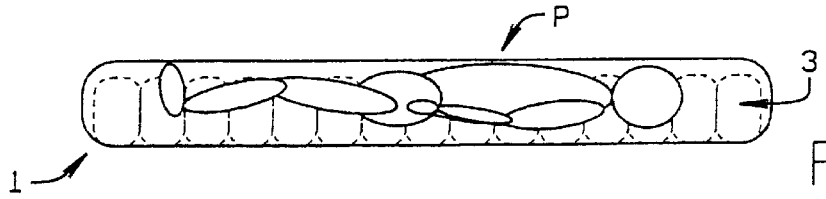
FIG. 5 is a side elevational view of the mattress with a person supported thereon after the initialization procedure is complete with the mattress inflated at a minimum operational pressure at which the person is properly supported in an air floatation mode.
Figure 6:
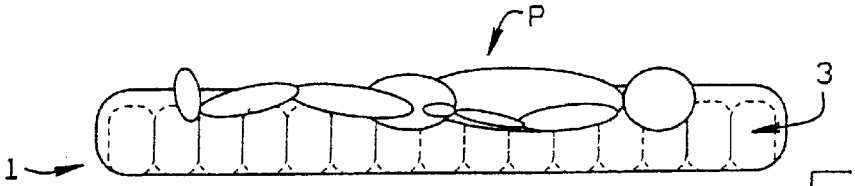
FIG. 6 is a view similar to FIG. 5 in which the mattress inflated at a maximum pressure at which the person is properly supported in a floatation mode.

Further in accordance with the method of the present invention, once the controller 25 determines that one or more of the cells 3 have fully inflated with the patient P supported on the mattress, the controller operates to shut off (or to markedly decreases) the air supplied to plenum 5 by blower 19. As noted, mattress 1 continuously loses air via air outlets 15 such that if air in sufficient quantity is not continuously supplied to the mattress cells, the mattress will deflate and the cells will collapse. This is shown in FIG. 4.

Figure 7B:
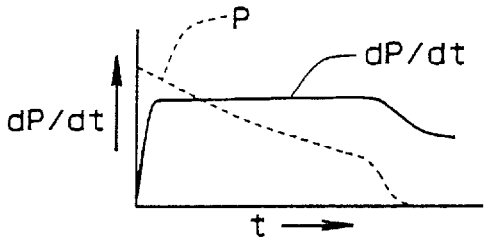
FIG. 7B is a graph illustrating a second step of the initializing procedure of the present invention in which the mattress is deflated with the collapse of at least one of the cells of the mattress causing a substantial decrease in the rate of the change of pressure.

As shown in FIG. 7B, controller 25 monitors the air pressure and the rate of change of the pressure vs. time (i.e., dp/dt) as the mattress deflates. Of course, since the deflation portion of this initialization procedure begins after at least some of the cells 3 have been fully inflated, the pressure of the cells starts off at a relatively high value and decreases at a substantially steady rate as the air leaks from the cells and as the cells partially collapse. In accordance with the methods of this invention, a signal is generated in response to one of the cells fully or partially collapsing. This signal may be generated in a number of ways in accordance with this invention. As shown in FIG. 7B, this collapse signal may be determined by the controller monitoring either the pressure or the rate of change of the pressure (or other functions of the pressure) as the mattress deflates. As shown in FIG. 7B, as the mattress deflates, the rate of change of the pressure in plenum 5 decreases at a substantially constant rate (as indicated by the substantially horizontal portion of the dp/dt curve in FIG. 7B) until a first of the cells fully collapses, at which point the rate of the pressure change drops more rapidly than during the deflation prior to the first cell collapsing.

When the controller 25 determines that the first cell has collapsed, this determines or establishes a lowermost inflation pressure which must be maintained at all times during the course of treatment or use of the mattress by the patient. Thus, the controller 25, after performing the above initialization procedure, will calculate or otherwise determine a desired operating pressure for the mattress so as to insure that none of the cells 3 are collapsed and so that none of the cells are fully inflated. Even more preferably, the controller 25 will control the pressure of the air in plenum 25 so that the cells are inflated with air at a desired operating pressure about 2–4 inches of water above the collapse pressure of the first cell to collapse thereby to insure that the patient P is supported in an air floatation manner with the lowest practical decubitus or interface pressure exerted on the patient's body so as to minimize the tendency to form bed sores and to enhance or maximize the comfort of the patient. It will be appreciated that when the above described initialization procedure is carried out with a particular patient P on the mattress, the maximum and minimum pressures so determined are specific to the particular patient P supported on the mattress and to the height and weight of that patient and how the patient's weight is distributed, and yet all that is required to initialize the controller is to initiate the automatic initialization procedure of the present invention which fully inflates and deflates the mattress. It will be appreciated that such initialization procedure may not only be carried out upon first placing a patient on the mattress, but also if the patient changes position or if the position or the mattress is significantly changed to more of a sitting or reclining position.

Figure 8:
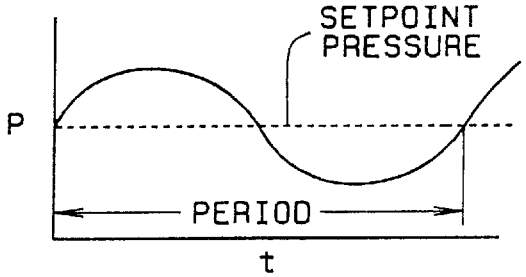
FIG. 8 is a graph of the operating pressure for a low air loss air floatation mattress controlled by a controller of the present invention operating at a setpoint pressure between the maximum and minimum pressure as determined by the initialization procedure (as illustrated in FIGS. 3–5) and periodically alternating above and below the setpoint pressure so as to support the person under different decubitus pressure levels.

It will also be appreciated that controller 25 may be programmed to maintain pressurization of mattress 1 within the above described maximum and minimum pressures for a patient and that the controller may cause the pressure of the mattress to vary in a predetermined manner such that various parts of the patient's body in contact with the mattress 1 are subjected to varying pressures so as to enhance blood circulation and to enhance comfort to the patient. As shown in FIG. 8, after the above described initialization procedure is performed and after a desired operation setpoint pressure for a patient is determined, controller 25 may be programmed to vary or oscillate the pressure above and below the setpoint pressure in a periodic (or a in a random) manner, but such that the pressure of the mattress is maintained within a desired range of pressures so as to prevent over pressurization of the cells and to insure that none of the cells fully collapses. Due to the various air leakage rates between various support cells 3 that are manufactured into the various models of air mattresses, the dynamic response of the patient and support mattress 1 being used relative to programmed changes in air pump pressure can result in harmonic flow of air into and out of the various support cells 3 resulting in a gentle rocking or massage action on the supported person P that can be sustained and result in a pleasant change in position and, in some cases, improved blood flow into the portions of the torso and extremities supported on the mattress.

Figure 9A:
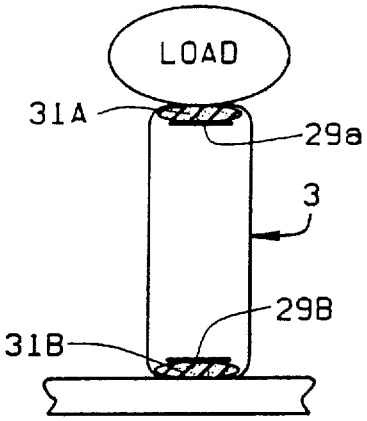
FIGS. 9A–9D diagrammatically depict a cell of a mattress, as shown in FIGS. 1–6 which are provided with sensors responsive to the collapse of the cell (as shown in FIG. 9D) and for generating a signal indicating the collapse of the cells with the cells illustrated in FIGS. 9A–9C illustrating, respectively, the cell in a fully inflated condition, in a higher pressure operating mode (FIG. 9B) and in a lower pressure operating mode (FIG. 9C)
Figure 9C:
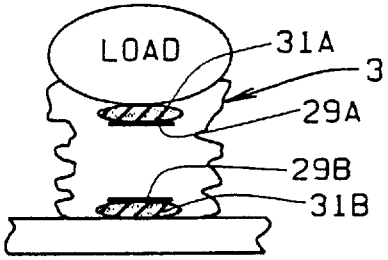
Figure 9B:
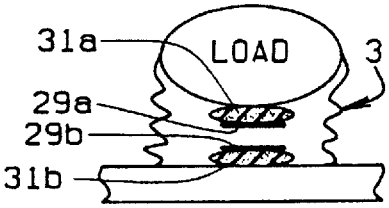
Figure 9D:
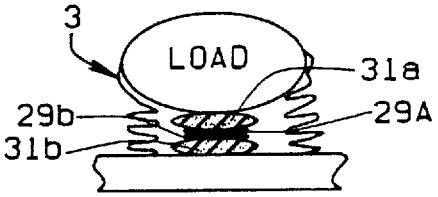
Figure 10:
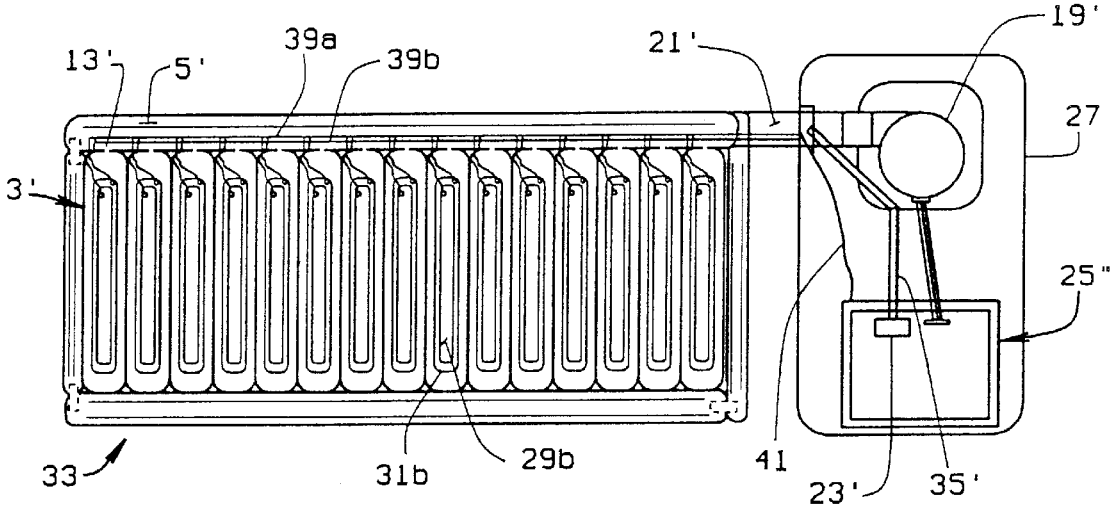
FIG. 10 is a top plan view of a low air loss mattress of similar construction to the mattress shown in FIG. 1 controlled by another variation of the control system of this invention in which each of the cells includes a pair of sensor elements (only the bottom element is shown) extending substantially across the width of the mattress for sensing the collapse of its respective cell and for generating a signal in response to such a collapse.

Referring now to FIGS. 9A–9D, individual cells 3 of a mattress 1 are shown in various states of inflation so as to illustrate another of the control methods of the present invention. Each of the cells 3 shown in FIGS. 9A–9D are provided with electrical sensors to determine collapse rather than to indirectly determine collapse of the cells as heretofore described in regard to FIG. 7B. More specifically, each cell 3 is shown to have a pair of electrical contacts 29*a*, 29*b* within the cell at the top and bottom thereof when the cell is at least partially inflated. Preferably, the sensors 29*a*, 29*b* are electrodes that span substantially the full width of the mattress (as shown in FIG. 10) and extend over a substantial portion of the width of each cell (i.e., in front to back direction of each cell) such that if any portion of sensor 29*a* comes into contact with any portion of sensor 29*b* (as shown in FIG. 9D), the contacts will electrically close and will generate a signal indicative of the collapse of that cell. Preferably, sensors 29*a*, 29*b* may be formed by a length of adhesive backed copper mesh fabric-like tape or copper foil applied to a suitable foam backing material 31*a*, 31*b* disposed between the copper fabric and the inner face of the fabric forming cell 3. In this manner, the foam provides a flexible backing for the copper fabric sensor and in the event the cell fully collapses, the foam provides some cushioning effect for the patient on the mattress. As shown in FIG. 9D, the electrical contacts 29*a*, 29*b* close upon the cell with which they are associated collapsing to about the position shown in FIG. 9D. It will be noted that this is used as an approximation of cell collapse, but it does not require that the cell be fully deflated such that the load bears directly on the surface supporting the cell. As shown, the cell is still about ⅓ inflated. Still further, it will be noted that the foam pads 31*a*, 31*b* interposed between the electrodes 29*a*, 29*b* serve to at least in part cushion the cell in the event of collapse beyond the position shown in FIG. 9D that giving at least some resilient support to the patient supported on the mattress.

Another embodiment of a low air loss mattress controlled in accordance with the present invention is shown in FIG. 10 and is indicated in its entirety at 33. Parts in mattress 33 having a similar construction and function as part in mattress 1 heretofore described are indicated by corresponding "primed" reference characters and thus will not be described in detail in relation to mattress 33. As indicated, each cell 3' of mattress 33 is provided with sensors 29*a*, 29*b* to detect collapse of each of the cells. Each of the sensors 29*a*, 29*b* is, respectively, electrically connected to electrical leads 39*a*, 39*b* which extend the length of mattress 33 within plenum 5'. The electrical leads 39*a*, 39*b* extend through duct or hose 21' and are connected to controller 25' by wires 41 within the cabinet 27. It will be appreciated that the sensors 29*a*, 29*b* thus serve as the contactors for a SPST switch that signal when the cell associated with a particular pair of sensors 29*a*, 29*b* has collapsed thus closing the contactors.

Figure 11:
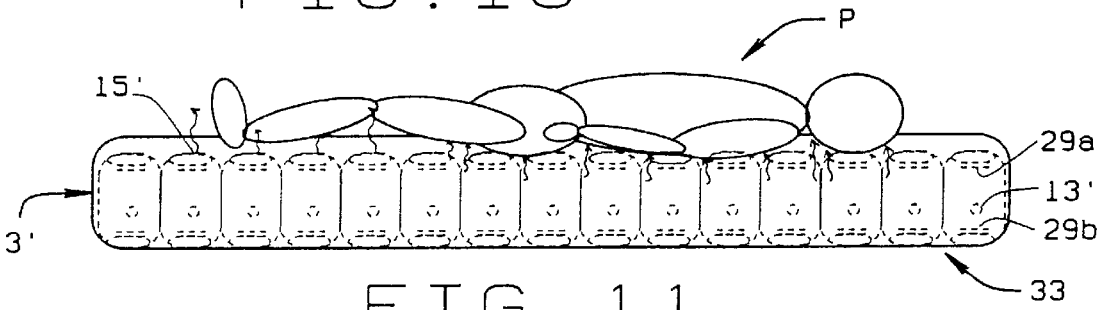
FIG. 11 is a side elevational view of the mattress shown in FIG. 10 with a patient supported on the mattress.

In the mattress shown in FIGS. 10 and 11, it will be appreciated that each of the cells 3' has an air inlet 13' permitting air from within the plenum 5' to flow into the cells and to inflate the cells. However, within the broader aspects of this invention, the manner in which the cells are inflated is not critical, it is only necessary that sufficient air be admitted into the cells so as to maintain inflation of the cells under the weight of the patient. For example, air may be admitted into the cells either directly from plenum via one or more air inlets 13' for each cells, or the cells may be provided with air from adjacent cells via air inlets 13*a*, as described above in regard to mattress 1. It will be further noted that each of the cells 3' has air outlets 15' which permit the continuous escape of air from within the cells which is characteristic of low air loss mattresses.

In accordance with this invention, the sensors 29*a*, 29*b* associated with each of the cells 3' of the seat zone 7', the head zone 9', and the foot zone 11' of mattress 33 are in electrical association with corresponding electrical resistors having sufficiently different electrical resistance such that controller 25' can determine in which of the zones a cell is first to be fully inflated upon the initialization procedure of the present invention being carried out. More specifically, the sensors 29*a*, 29*b* of the seat zone 7' may each be connected in series with a respective resistor (not shown) having, for example, a resistance of about $20^* 2_x$ ohms, where x is the cell number. For example in a 17 cell mattress, the cell at the foot of the mattress may be labeled $3_0$ and the cell at the head of the mattress may be numbered $3_{17}$.). The sensors 29*a*, 29*b* for each of the cells constituting the head zone 9' may each be connected in series with a respective resistor having a resistance of on the order of about 10,000 ohms, and each of the sensors 29*a*, 29*b* of the foot zone 11' may be connected in series with a respective resistor having a resistance of about 1 Meg. ohms. Thus, upon inflation of one of the cells 3' and upon the sensors 29*a*, 29*b* associated with that cell coming into electrical contact with one another anywhere along the length of the sensors thus closing a switch, the resistor associated with that collapsed cell allows the controller to determine whether the collapsed cell is in the seat, head or foot zones. It will be appreciated that such information may be used in the initialization procedure so as to determine the desired operating pressure of mattress 33 for that particular patient supported on the mattress.

Figure 12:
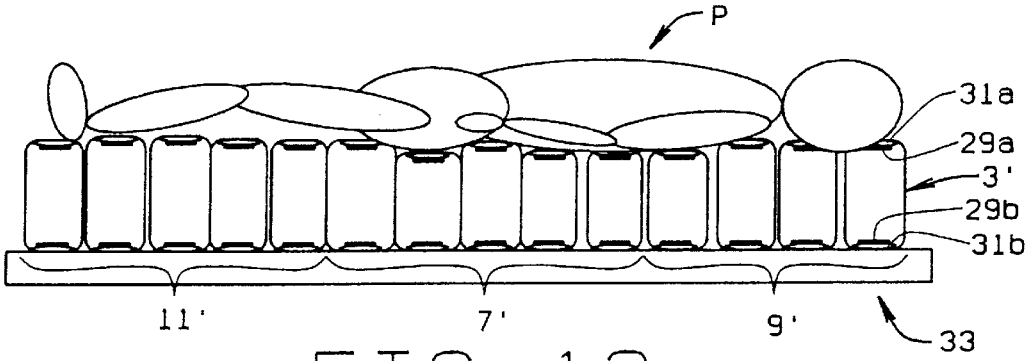
FIG. 12 is a diagrammatic side elevational view of a patient supported on a low air loss mattress controlled by a controller of the present invention with the cells of the mattress all nearly fully inflated.
Figure 13:
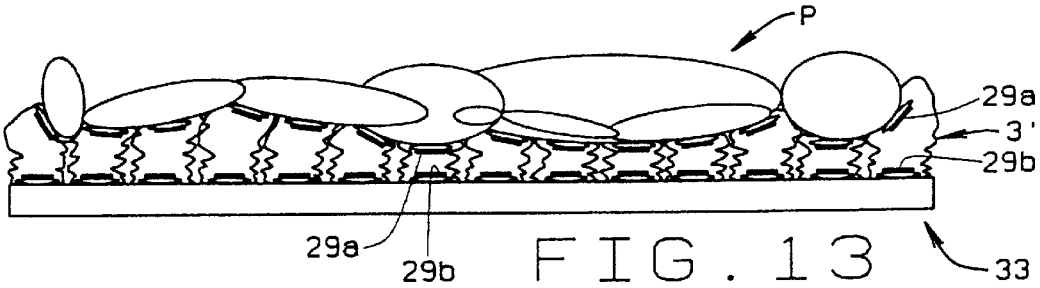
FIG. 13 is a view similar to FIG. 12 in which the cells are inflated to a desired operational pressure such that none of the cells are collapsed or such that none of the cells are fully inflated thereby to exert the minimum decubitus pressure on all portions of the patient's body.

In FIGS. 12 and 13, a patient P is shown supported on mattress 33 which is equipped with collapse sensors 29*a*, 29*b* in the manner heretofore described. Upon initiating the initialization procedure of the present invention on mattress 33 with patient supported thereon, the air pressure supplied to all of the cells 3' of mattress 33 will be increased so that all of the cells will fully inflate. As can be appreciated, because the weight of the patient's body is not uniformly carried by each of the cells 3' (e.g., more weight is supported by the seat zone cells than by the foot zone cells), some cells will expand in volume under the same air pressure to become fully inflated prior to others of the cells. In accordance with the initialization procedure of the present invention, the controller 27' of the present invention monitors the air pressure within duct 21' or plenum 5' (or even in each cell 3') and determines at what pressure the first cell 3' becomes fully inflated. This pressure at which one or more of the cells 3' with patient P supported on the mattress corresponds to a maximum operating pressure for the mattress below which the mattress should be operated thereby to insure that none of the cells are fully inflated. It will be appreciated that if any of the cells are fully inflated, they will have reduced surface area bearing on the supported body portions or surfaces and thus a greater interface pressure compared with when they are only partially inflated.

In accordance with the present invention, during the initialization procedure described above, during the full inflation portion of the procedure, the blower 19 raises the pressure of the air in plenum 5 until all of the switches 29*a*, 29*b* are open such that the patient is supported well above the support on which the mattress lies. It will be appreciated that the patient is thus supported on an air cushion and no portion of the patient's body has an interface pressure between his body and the mattress which exceed the pressure setting of blower 19. It has been found that a pressure setting for blower 19 of about 4–6 inches of water is usually sufficient to accomplish this for average size and weight patients P. As shown in FIGS. 9A–9D, more surface area of the patient's body (the load) is directly supported by the mattress cells 3 when the cells are less than fully inflated, as shown in FIG. 9A. This, of course, results in a lower support force per unit area of the patient's body which is desirable because it insures that the lowest possible decubitus or interface pressure is exerted on the patient's body which in turn lessens the tendency for decubitus lesions.

As indicated, this may be accomplished by the microprocessor monitoring either the pressure or the rate of increase of the pressure (dp/dt) in plenum 5' or in duct 21' and upon the controller detecting a predetermined increase in pressure or in the rate of increase of the pressures (or some other parameter) which is indicative of one or more of the cells 3' becoming fully inflated, another portion of the initialization procedure is initiated. Preferably, but not necessarily, this second portion of the initialization procedure is automatically initiated by the controller, but it may be initiated manually by having an operator actuate a suitable switch located on the control panel. It should also be noted that during initialization and during normal operation, the averaged ratio of the air pump drive level (i.e., the voltage supplied to air pump 19) to plenum pressure (voltage) is constantly monitored and if an error condition results such as if the measured ratio falls outside acceptable limits for a period of time exceeding 5–15 seconds audible and visual warnings are generated. Such an error condition can be caused by a ruptured mattress or defective air hose or defective hose connection. When such an error condition is detected, an audio (the beeper shown in FIG. 15) and visual (the service LEDs shown in FIG. 15) warnings are sounded or flashed to indicate that service is needed.

For the second portion of the initialization procedure after at least one of the cells 3' have been substantially fully inflated, the controller 27' controls the blower 19' such that cells 3' will be allowed to deflate with patient P still supported on the mattress 33. While the cells deflate, the controller determines when one of the cells fully collapses thus indicating a minimum operating pressure for mattress 33 which should be maintained at all times lest one or more of the cells 3' under the weight and under the weight distribution of patient P supported on the mattress will cause the cells to collapse such that at least some portion of the patient's body will not be supported by the mattress in an air floatation manner which could lead to the application of excessive decubitus or interface pressures on at least these portions of the patient's body. Even more preferably, the controller of the present invention is programmed to maintain the operating pressure as some intermediate pressure between the maximum desired operating pressure as determined by the controller during the initialization procedure upon one or more of the cells becoming fully inflated and the minimum pressure as determined by the collapse of at least one of the cells. Still even more preferably, the mattress is inflated at an operating pressure which is only somewhat above (e.g., 2–4 inches of water pressure) the minimum operating pressure so as to support the patient with the lowest practical decubitus pressure.

As shown in FIG. 13, with patient P reclining on mattress 33, certain of the cells 3' in the seat zone 7' are somewhat more collapsed than other cells in the foot and head zones, and yet the patient is still supported in a comfortable reclining position. It will be noted in FIG. 13 that all of the sensors 29*a*, 29*b* are maintained by the air pressure and air flow supplied to cells by the blower 19' in an open position so as to insure that none of the cells are fully collapsed.

Figure 14:
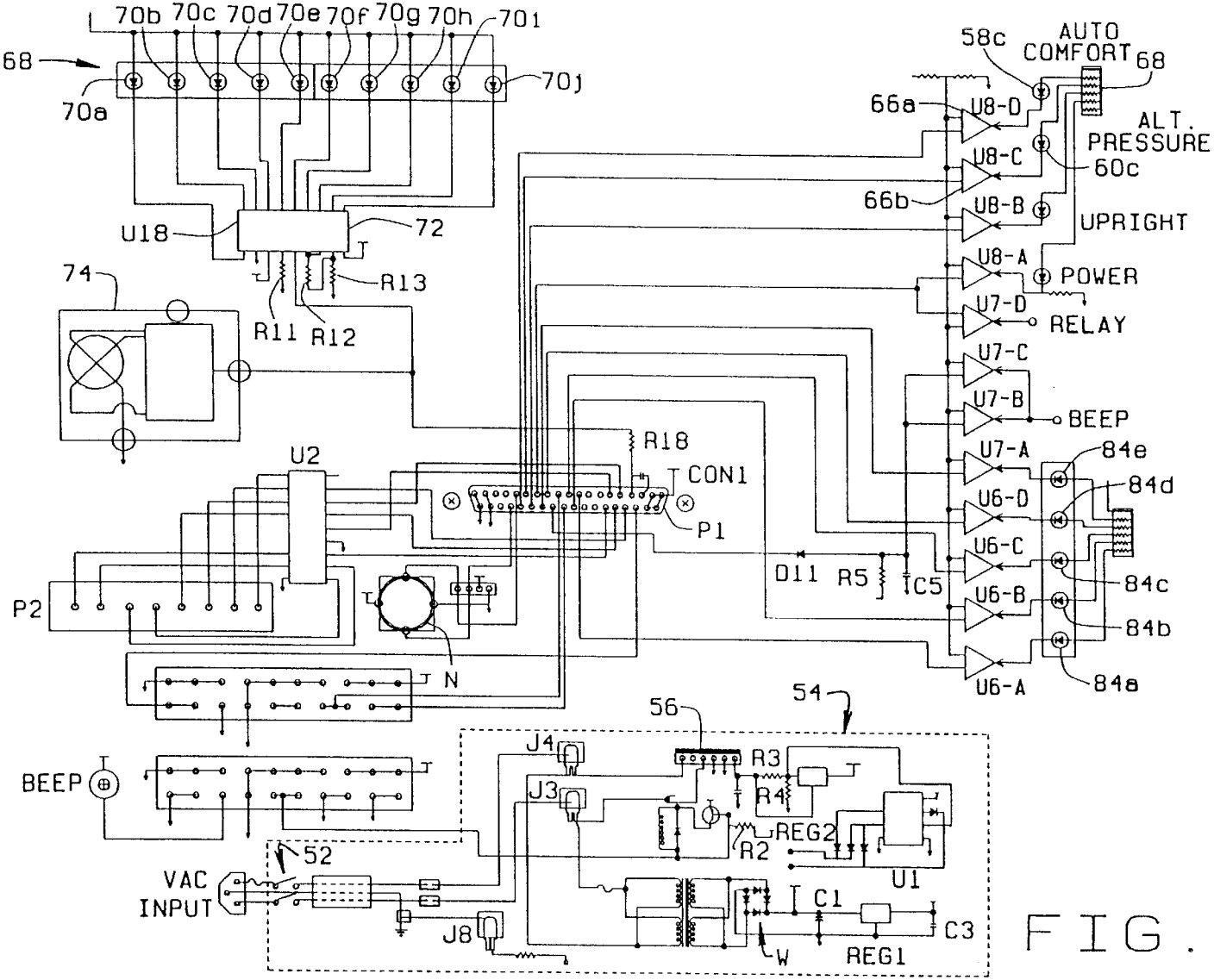
FIG. 14 is an electrical and electronic schematic of the controller of the present invention for controlling operation of a low air loss mattress in accordance with the method of the present invention.

Referring now to FIGS. 14–16, controller 25 of the present invention will be described in detail and its operation will be discussed as to how it monitors and controls the operation of the air pressurization system so as to carry out the above-discussed initialization procedure and maintains the cells of the mattress under a desired air pressure over an extended course of treatment or use.

More specifically, controller 25 includes a microprocessor. As shown, the microprocessor is incorporated in a microprocessor controller which may be purchased as an entire assembly from, for example, from various suppliers. One such pre-packaged microprocessor controller which is preferred and which is illustrated in FIG. 15 is a model XPLOR-32a microprocessor controller commercially available for Blue Earth Co. of Mankato, Minn. However, those skilled in the art will understand that many other types of microprocessors both from Blue Earth and other manufacturers may be readily used with the controller 25. Specifically, the microprocessor shown in FIG. 15 is indicated at U1. As shown in FIG. 15, the timing of the microprocessor is controlled by a crystal Y1 which oscillates at a frequency of approximately 11 MHz for example. A 5 volt D.C. input to the microprocessor is provided by a voltage regulator IC U2. A zener diode D1 is connected to the voltage regulator of the voltage regulator and the output of the output is applied to the appropriate microprocessor input through an inverter I1. The microprocessor has an associated 8K memory provided by an EEPROM U3. Inputs to the microprocessor from the various sensors are supplied through a connector P1 to an analog-to-digital converter (ADC) which is implemented by an IC U4. The mating portion of connector P1 is shown in FIG. 14. Various inputs to and from the microprocessor are routed through inverters I2–I4. Inverters I1–I4 are commonly implemented on an IC U5.

With respect to the other components shown in FIG. 16, the accompanying components list identifies the respective parts by the part numbers shown in the drawing.

Parts List For FIG. 15

C1 Capacitor, 47 μfd, 6.3 V
C2, C3, C4 Capacitor, 1 μfd 50VX7R
C5, C6 Capacitor, 33 μfd
C7 Capacitor, .1 μfd
C8 Capacitor, 10 μfd
C9, C10 Capacitor, .1 μfd
D1 Diode, 1N5233B
D2 Diode, 1N4148
P1 Connector, 37 pin
R1 Resistor, 30K, 5%
R3 Resistor, 3.9k
R4 Resistor, 1K
R5 Resistor, 100k
Y1 Clock Crystal
U1 IC, 80C32 Microprocessor
U2 IC, 5V Regulator (LP2951-03)
U3 IC, EEPROM, 8Kx8 w/TB52
U4 IC, 10-bit ADC
U5 IN, 80C32 Microprocessor In operation, microprocessor U1 sets the air pump 19 level by setting the drive voltage to a level between about 1.5 and 4.99 volts (i.e., 0–15 inches of water), and calculates the value dp /dt within duct 21 as the cells in the mattress are inflated. When the sharp increases in pressure or in the rate of increase of pressure (dp/dt) previously discussed occur during the initialization procedure of the present invention indicating that at least one of the cells 3 of the mattress sections are substantially fully inflated and that the fabric forming that cell is taut, the microprocessor provides a control output to deflate the mattress. When the calculated dp/dt value (or other desired parameter which is being monitored) indicates that at least one of the cells has collapsed (as detected by the change in pressure or in dp/dt as shown in FIG. 7B, or as detected upon the sensors 29*a*, 29*b* of the mattress shown in FIG. 10 making electrical contact with one another), the microprocessor provides a second control output to stop the deflation. Now, the microprocessor calculates the appropriate inflation level for the patient (as discussed above), and subsequently controls the inflation pressure level of the cells in accordance with the program set out in Appendix 1 to this Specification. Besides the sensor inputs, the microprocessor controls cell pressurization in accordance with manual inputs provided by the switches on control panel 50.

In FIG. 16, control panel 50 is shown to have a power switch 52 for turning the system on and off. In FIG. 14, switch 52 is shown to be part of a power supply 54 of the controller and to include a step down transformer XFMR1, a full-wave rectifier bridge W1, and a voltage regulator REG 1. The output from REG 1 is used to power the electronics portion of the system. The 115–120 VAC input voltage is further routed through switch 52 to a power strip 56 by which the AC voltage is supplied to blower 19.

Next, there are a series of switches located on the panel. These include Auto Comfort on and off switches 58*a*, 58*b*, ALT Pressure on and off switches 60*a*, 60*b*, and System Lock switches 62 LOCK) and 64 (PGM1). Turning switch 58*a* on causes a LED 58*c* to be illuminated via a comparator 66*a* and a resistor unit 68 which includes a plurality of parallel connected resistors which are commonly connected to a voltage source. Turning switch 60*a* on causes a LED 60*c* to be illuminated via a comparator 66*b* and the resistor unit.

With Auto Comfort switch 58*a* on, a desired comfort level can be established. A comfort level display 68 accommodates ten comfort level settings 1–10 as shown in FIG. 16. Display 68 is a bar graph type display incorporating ten LEDs 70*a*–70*j*. One side of all of the LEDs are commonly connected to a voltage source. The other side of the LEDs are separately connected to an IC 72 which is a summing unit whose current value determines which LEDs are illuminated to represent the current comfort level setting. An input to the summing unit is provided by pressure sensor 74. As sensor 74 senses an increase in pressure, the contents of the summing unit are incremented. Conversely, as the sensor senses a decrease in pressure, the contents of the summing unit are decremented.

If desired, the time to fully inflate the air mattress can be preset. For this purpose, a Full Inflate on switch 80*a* and Full Inflate off switch 80*b* are located on the front of control panel 50. The inflation time is adjustable in five minute increments from 5 minutes to 25 minutes. A Time switch 80*c* allows the inflation time to be adjusted from one five minute interval to another. An interval display 82 includes five LEDs 84*a*–84*e* for indicating the selected five minute interval.

In view of the above, it will be seen that the several objects and features of this invention are achieved and other advantageous results obtained.

As various changes could be made in the above constructions and methods without departing from the scope of the invention herein described, it is intended that all matter contained in the above description or shown in the accompanying drawings shall be interpreted as illustrative and not in a limiting sense.

What is claimed is:

1. A method of initializing and controlling the inflation of a low air loss air floatation mattress or other pad for supporting a person's body with a decubitus pressure maintained below a desired maximum decubitus pressure level during an extended period of use and for insuring that no portion of the mattress collapses during said extended period of use, an air supply system which continuously supplies air to said mattress, said mattress having an air inlet and a multiplicity of air discharge opening such that air must be continuously supplied to said mattress at a flowrate and pressure to maintain the mattress at a desired inflation pressure, said method comprising the steps of:

placing the person to be supported by said mattress on said mattress;

inflating said mattress;

measuring the pressure of the air supplied to said mattress by said air supply system;

monitoring the rate of the change of the inflation pressure of said mattress;

determining the pressure at which at least a portion of said mattress becomes fully inflated;

deflating said mattress;

determining the pressure at which at least a portion of said mattress attains at least a partially collapsed condition; and controlling operation of said source of pressurized air over an extended period of time when the person is supported by said mattress so as to maintain a pressure within said mattress intermediate said full inflation pressure and said collapse pressure whereby said person is supported by said mattress with a decubitus pressure less than a desired maximum decubitus pressure.

2. The method of claim 1 wherein said step of determining the pressure at which at least a portion of said mattress becomes fully inflated comprises determining the pressure at which the rate of change of the pressure sharply increases.

3. The method of claim 1 wherein said step of determining the pressure at which at least a portion of said mattress attains at least a partially collapsed condition comprises determining the pressure at which the rate of change of the inflation pressure during deflation decreases substantially.

4. The method of claim 1 wherein said step of determining the pressure at which at least a portion of said mattress attains at least a partially collapsed condition comprises sensing when at least one of said cells at least partially collapses and generating a signal in response to such partial collapse.

* * * * *